US005775576A

United States Patent [19]

Stone

[11] Patent Number: 5,775,576

[45] Date of Patent: Jul. 7, 1998

[54] FLIP-TOP RECLOSABLE CARTON WITH REDUCED-WEIGHT LINER

[75] Inventor: James L. Stone, Grand Rapids, Mich.

[73] Assignee: Tenneco Packaging

[21] Appl. No.: 687,789

[22] Filed: Jul. 19, 1996

[51] Int. Cl.[6] ..... B65D 5/56; B65D 5/68

[52] U.S. Cl. ..... 229/225; 220/410; 220/416; 220/418

[58] Field of Search ..... 220/408, 410, 220/416, 418, 441, 443; 229/225

[56] References Cited

U.S. PATENT DOCUMENTS

| | | | |
|---|---|---|---|
| 887,729 | 5/1908 | Kirmse | 220/416 |
| 3,744,702 | 7/1973 | Ellison | 220/418 |
| 4,726,471 | 2/1988 | Whately et al. | 220/416 |
| 5,154,343 | 10/1992 | Stone | 227/225 |
| 5,161,734 | 11/1992 | Ruehl et al. | 229/227 |
| 5,215,248 | 6/1993 | Moser | 229/23 R |
| 5,219,089 | 6/1993 | Kiolbasa et al. | 220/441 |
| 5,236,123 | 8/1993 | Stone et al. | 229/225 |
| 5,238,179 | 8/1993 | Hart | 220/418 |
| 5,265,799 | 11/1993 | Stone | 229/225 |
| 5,277,360 | 1/1994 | DeMott | 229/112 |
| 5,314,114 | 5/1994 | Stone | 229/225 |
| 5,363,981 | 11/1994 | Giblin et al. | 220/416 |
| 5,373,960 | 12/1994 | Gunn et al. | 220/416 |
| 5,439,133 | 8/1995 | Stone | 220/418 |
| 5,505,374 | 4/1996 | Stone | 229/227 |
| 5,515,996 | 5/1996 | Stone | 229/224 |
| 5,551,938 | 9/1996 | Stone | 493/96 |
| 5,673,849 | 10/1997 | Stone | 229/227 |

*Primary Examiner*—Gary E. Elkins
*Attorney, Agent, or Firm*—Arnold, White & Durkee

[57] ABSTRACT

A carton-liner assembly comprises an outer carton and a liner disposed within and affixed to the carton. The carton includes opposing top and bottom carton walls, opposing front and back carton walls, and opposing first and second side carton walls. The front carton wall and the opposing side carton walls include a continuous tear strip for opening up the carton from a sealed form to form a lid hingedly connected to a base. The liner includes a front liner wall and opposing side liner walls adjacent to the respective front carton wall and opposing side carton walls of the carton. The liner optionally includes a back liner wall adjacent to the back carton wall of the carton. To reduce the weight of the carton-liner assembly, the walls of the liner include a series of stripped-out areas. Preferably, the stripped-out areas are elongated in a vertical direction and have respective arrow-shaped lower ends. Each liner wall includes a pair of stripped-out areas separated by a center strut. The liner walls intersect at vertical corner posts, and the pair of stripped-out areas on each liner wall are spaced away from these vertical corner posts.

17 Claims, 4 Drawing Sheets

FLIP-TOP RECLOSABLE CARTON WITH REDUCED-WEIGHT LINER

FIELD OF THE INVENTION

The present invention relates generally to flip-top reclosable cartons and, more particularly, relates to a flip-top reclosable carton having a reduced-weight liner.

BACKGROUND OF THE INVENTION

An exemplary flip-top reclosable carton-liner assembly is disclosed in U.S. Pat. No. 5,265,799 to Stone. The carton-liner assembly includes an outer carton and a liner disposed within the carton to provide the assembly with top-load compression strength. The outer carton has opposing top and bottom carton walls, opposing front and back carton walls, and opposing side carton walls. The side carton walls and the front carton wall include a continuous tear strip for opening up the carton from a sealed form. The liner includes opposing front and back liner walls and opposing side liner walls adjacent to the respective opposing front and back carton walls and opposing side carton walls of the carton. An advantage of the foregoing carton-liner assembly is that it is capable of being safely stacked during storage, transportation, and shelf display.

Unfortunately, many countries have regulations which impose penalty costs based on the weight of the materials sold. While the liner in the foregoing carton-liner assembly provides a desirable amount of top-load compression strength, it adds a significant amount of weight to the carton-liner assembly, thereby leading to exorbitant penalty costs. A need therefore exists for a carton-liner assembly that weighs significantly less than the foregoing carton-liner assembly without sacrificing top-load compression strength.

SUMMARY OF THE INVENTION

A carton-liner assembly comprises an outer carton and a liner disposed within and affixed to the carton. The carton includes opposing top and bottom carton walls, opposing front and back carton walls, and opposing first and second side carton walls. The front carton wall and the opposing side carton walls include a continuous tear strip for opening up the carton from a sealed form to form a lid hingedly connected to a base. The liner includes a front liner wall and opposing side liner walls adjacent to the respective front carton wall and opposing side carton walls of the carton. The liner optionally includes a back liner wall adjacent to the back carton wall of the carton.

To reduce the weight of the carton-liner assembly, the walls of the liner include a series of stripped-out areas. Preferably, the stripped-out areas are elongated in a vertical direction and have respective arrow-shaped lower ends. Each liner wall includes a pair of stripped-out areas separated by a center strut. The liner walls intersect at vertical corner posts, and the pair of stripped-out areas on each liner wall are spaced away from these vertical corner posts.

BRIEF DESCRIPTION OF THE DRAWINGS

Other objects and advantages of the invention will become apparent upon reading the following detailed description and upon reference to the drawings in which.

Figure 1:
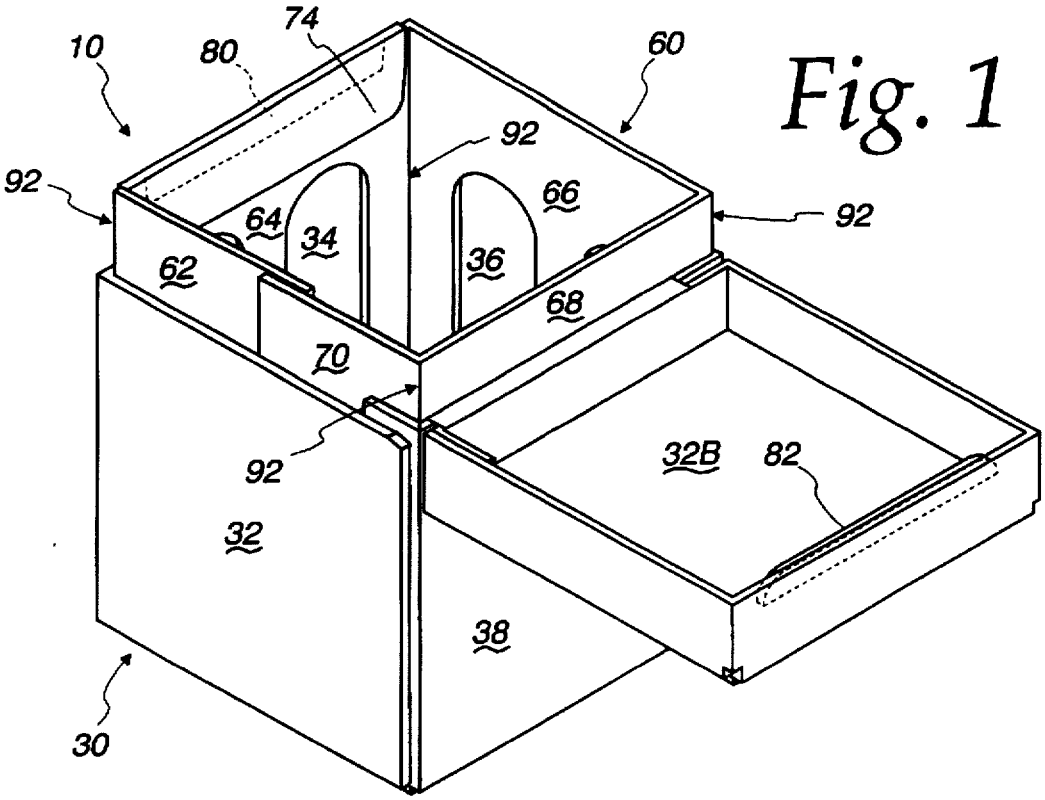
FIG. 1 is a perspective view of a flip-top reclosable carton-liner assembly showing the carton in opened form.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Figure 2:
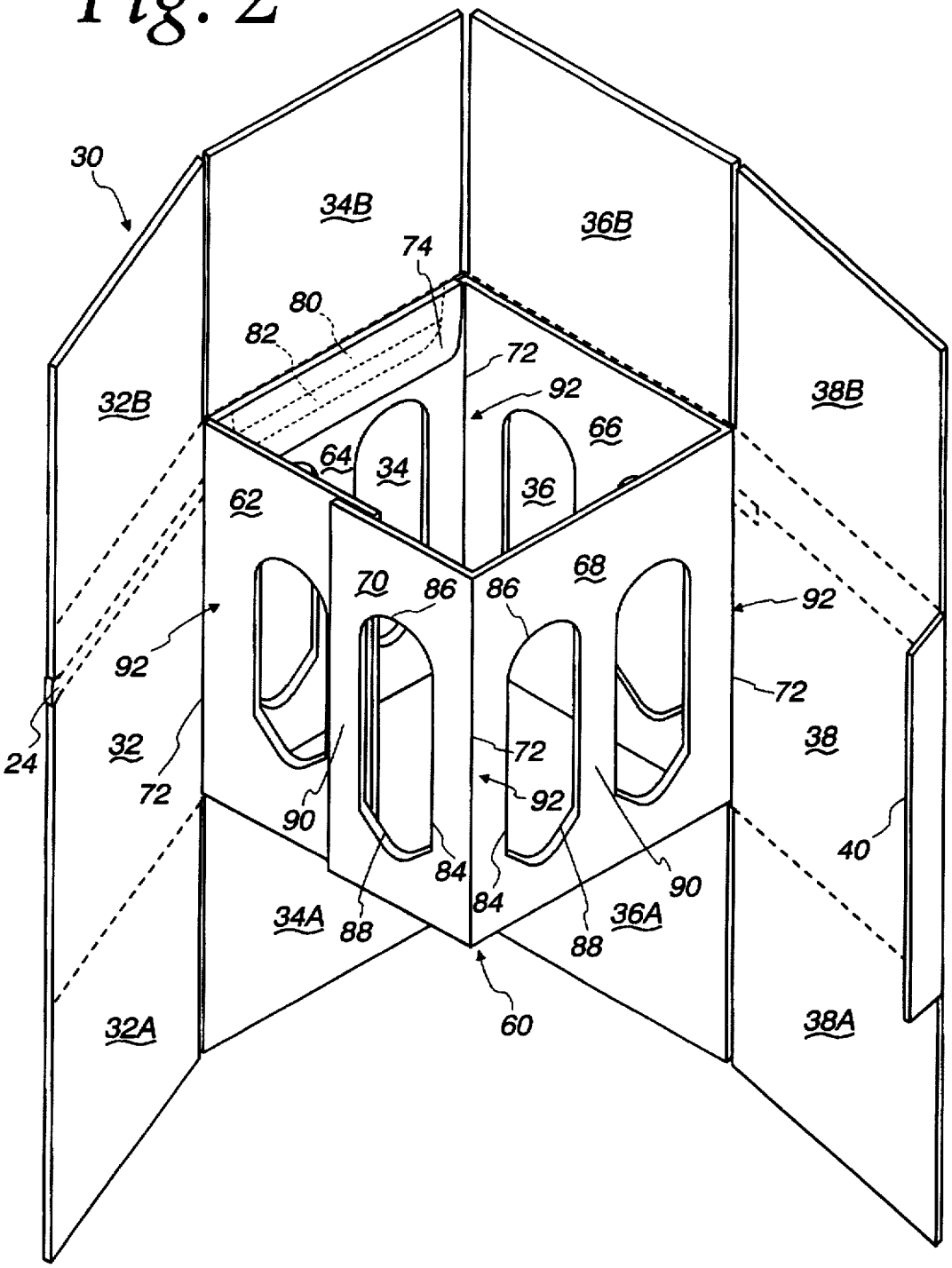
FIG. 2 is a perspective view of the carton-liner assembly showing a formed reduced-weight liner within the partially-folded outer carton.

Turning now to the drawings, FIGS. 1 and 2 depict a carton-liner assembly 10 including an outer carton 30 and a liner 60 disposed within the carton 30. The carton 30 includes opposing top and bottom carton walls, opposing front and back carton walls 34 and 38, and opposing first and second side carton walls. The top carton wall is defined by overlapping flaps 32B, 34B, 36B, and 38B (FIG. 2), and the bottom carton wall is defined by overlapping flaps 32A, 34A, 36A, and 38A (FIG. 2). The first side carton wall is defined by overlapping panel 32 and glue flap 40 (FIG. 2), while the second side carton wall is defined by panel 36. The inner surface of the panel 32 is adhered to the outer surface of the glue flap 40 by adhesive. The side panels 32 and 36 and the front wall 34 include an integral and continuous horizontal tear strip 24 for opening up the carton 30 from a sealed form to form a lid hingedly connected to a base.

FIG. 2 illustrates the liner 60 on the inside of the partially-formed carton 30. The liner 60 has a four-sided tubular shape and includes opposing front and back liner walls 64 and 68 and opposing first and second side liner walls. The first side liner wall is defined by partially overlapping panels 62 and 70, while the second side liner wall is defined by panel 66. The partially overlapping panels 62 and 70 are adhered to each other along the region of overlap. The liner 60 is dimensioned to fit snugly within the carton 30 when the carton 30 is fully formed as shown in FIG. 1. The liner 60 may be adhered to the inside of the carton 30 by an adhesive applied to one or more walls of the liner 60. In a preferred embodiment, outer surfaces of the front and back liner walls 64 and 68 are partially adhered to the inner surface of the corresponding front and back carton walls 34 and 38 of the carton 30.

Figure 3:
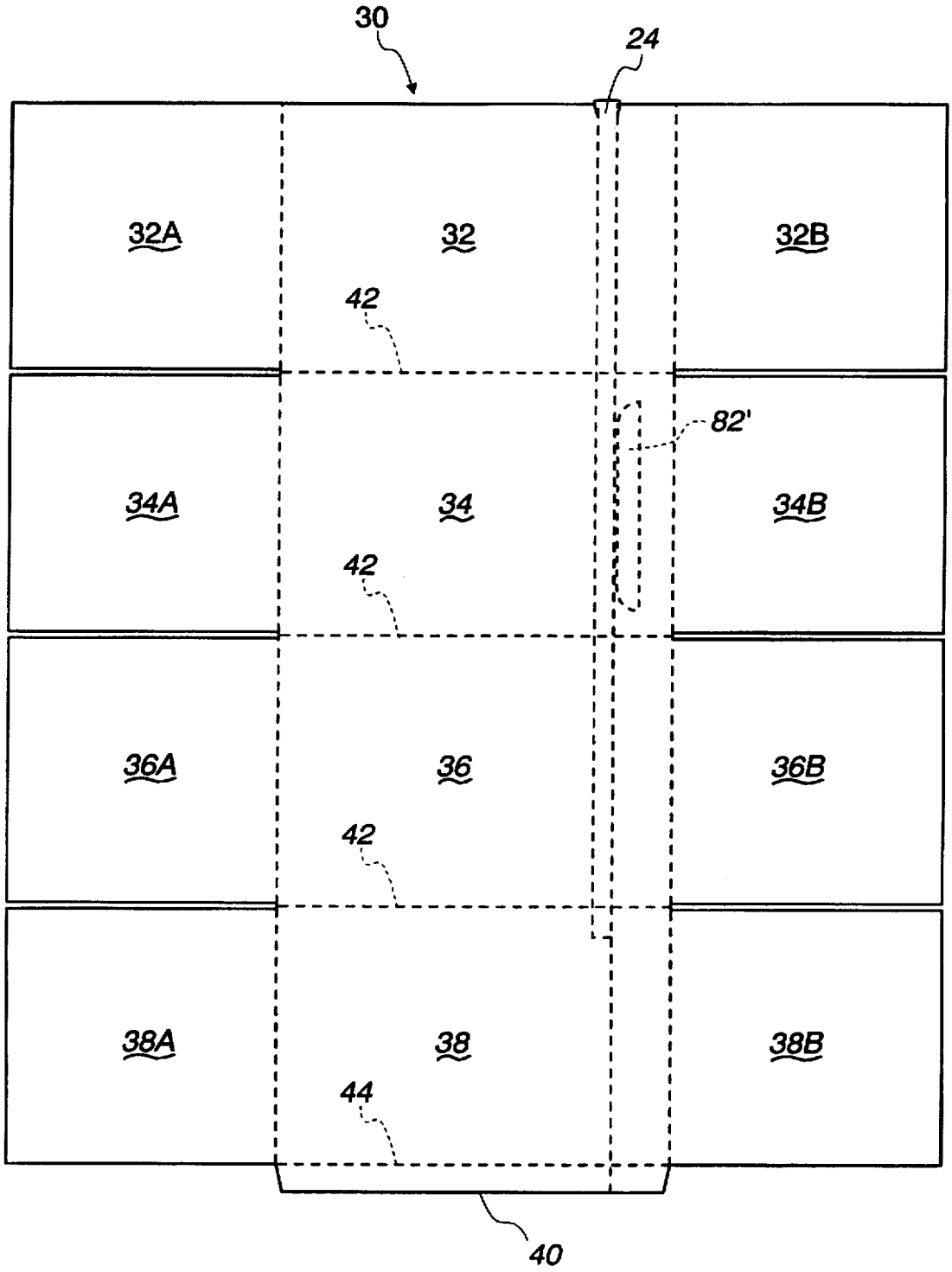
FIG. 3 is a top plan view of an inside surface of a paperboard blank used to form the carton of the carton-liner assembly.

FIG. 3 illustrates a plan view of an inside surface of a unitary, continuous paperboard blank used to form the carton 30. Portions of the carton blank corresponding to portions of the carton 30 are designated by the same reference numerals. The blank includes a plurality of panels and flaps hingedly connected to each other along vertical and horizontal fold lines (as viewed in FIG. 3) to facilitate folding of the panels and flaps relative to each other. Specifically, four vertically aligned, substantially rectangular panels 32, 34, 36, and 38 are hingedly connected to each other along the horizontal fold lines 42. A glue flap 40 is hingedly connected to the panel 38 along the horizontal fold line 44.

Each of the four main panels 32, 34, 36, and 38 is provided with a pair of closure flaps hingedly connected to opposing vertical edges of the associated panel. For example, first-in closure flaps 32A and 32B are hingedly connected to the panel 32; fourth-in closure flaps 34A and 34B are hingedly connected to the panel 34; second-in closure flaps 36A and 36B are hingedly connected to the panel 36; and third-in closure flaps 38A and 38B are hingedly connected to the panel 38. These closure flaps cooperate in conventional manner to form the top and bottom walls of the carton 30 (see FIG. 2). In one embodiment, the top closure flaps are folded inward in the following sequence to form the top wall: flap 32A, flap 36A, flap 38A, and flap 34A. Likewise, the bottom closure flaps are folded inward in the following sequence to form the bottom wall: flap 32B, flap 36B, flap 38B, and flap 34B. Other folding sequences are possible.

Figure 4:
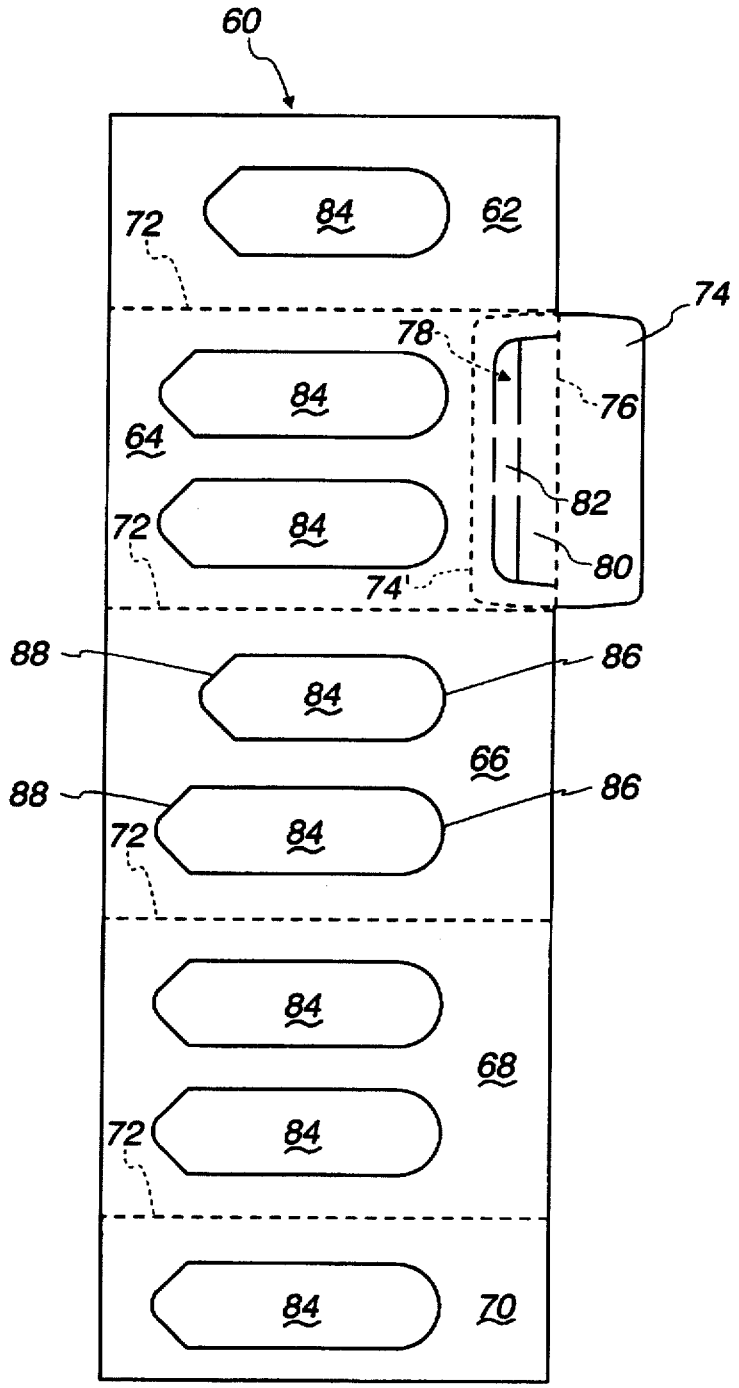
FIG. 4 is a top plan view of an inside surface of a paperboard blank used to form the liner of the carton-liner assembly.

FIG. 4 illustrates a plan view of an inside surface of a unitary, continuous paperboard blank used to form the liner 60. Portions of the liner blank corresponding to portion of the liner 60 are designated by the same reference numerals. The liner blank includes five vertically aligned, substantially rectangular panels 62, 64, 66, 68, and 70 hingedly connected to each other along horizontal fold lines 72 to facilitate folding of these panels relative to each other.

The liner blank further includes an overhanging flap 74 hingedly connected to the panel 64 along the vertical fold line 76. This overhanging flap 74, in combination with a die-cut portion 78, is used to form an optional reclosure feature for the carton 30. The die-cut portion 78 includes a proximal hinged flap 80 and a distal island portion 82. The proximal flap 80 is hingedly connected to the overhanging flap 74 along the same fold line 76 which links the overhanging flap 74 to the panel 64. The distal island portion 82 is linked to the leading vertical edge (as viewed in FIG. 4) of the hinged flap 80 by means of weakening nicks whereby the island portion 82 may easily be separated from both the surrounding portion of the panel 64 and the hinged flap 80.

Figure 5:
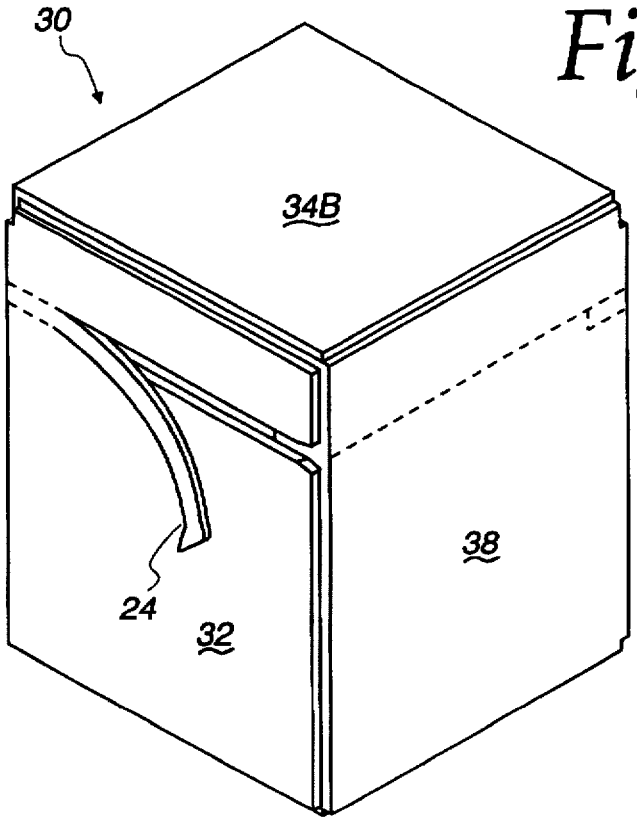
FIG. 5 is a perspective view of the carton-liner assembly showing the carton in sealed form with a tear strip partially removed.

As the optional reclosure feature is disclosed at length in U.S. Pat. No. 5,265,799 to Stone, incorporated herein by reference, it will not be described in detail herein. It suffices to state that the outer surface of the island portion 82 is fixedly adhered to the inner surface of the front carton wall 34 above the tear strip 24 generally in a position 82' indicated by dashed lines in FIG. 3. Also, as best shown in FIGS. 1 and 2, the overhanging flap 74 is folded inward approximately 180 degrees relative to the front wall 64 and is adhered to the inner surface of the front wall 64. The position of the overhanging flap 74 after it has been folded is indicated by the reference numeral 74' in FIG. 4. The reclosure feature is such that when the carton-liner assembly of FIG. 5 is formed from the carton and liner blanks of respective FIGS. 3 and 4 and the carton 30 is initially opened by tearing away the tear strip 24 and upwardly raising the lid thereof, the island portion 82 breaks free of its restricting nicks and remains attached to the lid as shown in FIG. 1. The hinged flap 80, on the other hand, remains hingedly connected to the overhanging flap 74. When the lid is reclosed, the island portion 82 snappingly engages with the hinged flap 80 to provide tactile and audible feedback indicative of effective reclosure.

To reduce the weight of the carton-liner assembly, the walls of the liner 60 include a series of stripped-out areas 84 as best depicted in FIGS. 2 and 4. The stripped-out areas 84 are designed to maximize the top-load compression strength of the formed carton-liner assembly in FIGS. 1 and 5. For example, the stripped-out areas 84 are elongated in a vertical direction in FIGS. 1 and 5 and have a height which is generally greater than half the distance between the top and bottom walls of the carton 30. Further, the stripped-out areas 84 include semicircular-shaped or arch-shaped upper ends 86 and arrow-shaped lower ends 88. In addition to maximizing the top-load compression strength of the carton-liner assembly, the arrow-shaped lower ends 88 insure that certain nongranular products do not "snag" or "catch" on the lower ends of the stripped-out areas 84 when loaded into the assembly.

Each wall of the liner 60 preferably includes a pair of the stripped-out areas 84 separated by (disposed on opposite sides of) a center support column or strut 90. The four liner walls intersect at four vertical corner posts 92 (FIGS. 1 and 2). The pair of stripped-out areas 84 on each liner wall are spaced away from these vertical corner support posts 92 so that they do not adversely affect the top-load compression strength. The distance between the pair of stripped-out areas 84 on each liner wall (width of the center strut 90) is approximately the same as the distance between each stripped-out area 84 and the fold line 72 of the nearest corner post 92. The specific configuration and locations of the stripped-out areas 84 described above allow the carton-liner assembly to weigh significantly less than the carton-liner assembly of the prior art without sacrificing top-load compression strength.

While the present invention has been described with reference to one or more particular embodiments, those skilled in the art will recognize that many changes may be made thereto without departing from the spirit and scope of the present invention. For example, the liner 60 may be modified to eliminate the back wall 68 or to include only a partial back wall consisting of nonoverlapping flaps extending from the opposing liner side walls. Each of these embodiments and obvious variations thereof is contemplated as falling within the spirit and scope of the claimed invention, which is set forth in the following claims.

What is claimed is:

1. A paperboard carton-liner assembly, comprising:

an outer carton including opposing top and bottom carton walls, opposing front and back carton walls, and opposing first and second side carton walls, said front carton wall and said side carton walls including an integral and continuous horizontal tear element for opening up said carton from a sealed form to form a lid hingedly connected to a base; and a liner disposed within said outer carton and including a front liner wall and opposing first and second side liner walls, said front liner wall being adjacent to said front carton wall, said first and second side liner walls being adjacent to said respective first and second side carton walls, each of said front liner wall and said side liner walls including a respective pair of stripped-out areas entirely encompassed by paperboard material.

2. The carton-liner assembly of claim 1, wherein each of said front liner wall and said side liner walls includes a center strut separating said respective pair of stripped-out areas.

3. The carton-liner assembly of claim 2, wherein said front liner wall and said side liner walls intersect at adjoining corner posts, and said pair of stripped-out areas of each of said front liner wall and said side liner walls are spaced away from said corner posts.

4. The carton-liner assembly of claim 3, wherein a distance between said respective pair of stripped-out areas is approximately equal to a distance between said respective pair of stripped-out areas and a nearest one of said corner posts.

5. The carton-liner assembly of claim 4, wherein said stripped-out areas are elongated in a direction generally parallel to said corner posts and said center strut.

6. The carton-liner assembly of claim 5, wherein said stripped-out areas have a height generally greater than about half a distance between said top and bottom carton walls.

7. The carton-liner assembly of claim 1, wherein said stripped-out areas each include an arch-shaped upper end.

8. The carton-liner assembly of claim 1, wherein said stripped-out areas each include a downwardly-pointing, generally arrow-shaped lower end.

9. The carton-liner assembly of claim 1, wherein said liner further includes a back liner wall opposing said front liner wall, said back liner wall including a pair of said stripped-out areas.

10. A paperboard carton-liner assembly, comprising:

an outer carton including opposing top and bottom carton walls, opposing front and back carton walls, and opposing first and second side carton walls, said front carton wall and said side carton walls including an integral and continuous horizontal tear element for opening up said carton from a sealed form to form a lid hingedly connected to a base; and a liner disposed within said outer carton and including a front liner wall and opposing first and second side liner walls, said front liner wall being adjacent to said front carton wall, said first and second side liner walls being adjacent to said respective first and second side carton walls, at least one of said front liner wall and said side liner walls including a first stripped-out area entirely encompassed by paperboard material, said front liner wall and said side liner walls intersecting at adjoining corner posts, said first stripped-out area being spaced away from a nearest one of said corner posts, said first stripped-out area being within said outer carton when said lid is open.

11. A paperboard carton-liner assembly, comprising:

an outer carton including opposing top and bottom carton walls, opposing front and back carton walls, and opposing first and second side carton walls, said front carton wall and said side carton walls including an integral and continuous horizontal tear element for opening up said carton from a sealed form to form a lid hingedly connected to a base;

a liner disposed within said outer carton and including a front liner wall and opposing first and second side liner walls, said front liner wall being adjacent to said front carton wall, said first and second side liner walls being adjacent to said respective first and second side carton walls, at least one of said front liner wall and said side liner walls including first and second stripped-out areas entirely encompassed by the paperboard material, said second stripped-out area being separated from said first stripped-out area by a center strut, said front liner wall and said side liner walls intersecting at adjoining corner posts, and said first and second stripped-out areas being spaced away from a nearest one of said corner posts.

12. A paperboard carton-liner assembly, comprising:

an outer carton including opposing top and bottom carton walls, opposing front and back carton walls, and opposing first and second side carton walls, said front carton wall and said side carton walls including an integral and continuous horizontal tear element for opening up said carton from a sealed form to form a lid hingedly connected to a base;

a liner disposed within said outer carton and including a front liner wall and opposing first and second side liner walls, said front liner wall being adjacent to said front carton wall, said first and second side liner walls being adjacent to said respective first and second side carton walls, at least one of said front liner wall and said side liner walls including first and second stripped-out areas entirely encompassed by the paperboard material, said second stripped-out area being separated from said first stripped-out area by a center strut, said front liner wall and said side liner walls intersecting at adjoining corner posts, said first and second stripped-out areas being separated by a distance approximately equal to a distance between each of said stripped-out areas and a nearest one of said corner posts.

13. A paperboard carton-liner assembly, comprising:

an outer carton including opposing top and bottom carton walls, opposing front and back carton walls, and opposing first and second side carton walls, said front carton wall and said side carton walls including an integral and continuous horizontal tear element for opening up said carton from a sealed form to form a lid hingedly connected to a base;

a liner disposed within said outer carton and including a front liner wall and opposing first and second side liner walls, said front liner wall being adjacent to said front carton wall, said first and second side liner walls being adjacent to said respective first and second side carton walls, at least one of said front liner wall and said side liner walls including a first stripped-out area entirely encompassed by paperboard material, said front liner wall and said side liner walls intersecting at adjoining corner posts, said first stripped-out area being spaced away from a nearest one of said corner posts, said first stripped-out area being elongated in a direction generally parallel to said corner posts.

14. A paperboard carton-liner assembly, comprising:

an outer carton including opposing top and bottom carton walls, opposing front and back carton walls, and opposing first and second side carton walls, said front carton wall and said side carton walls including an integral and continuous horizontal tear element for opening up said carton from a sealed form to form a lid hingedly connected to a base;

a liner disposed within said outer carton and including a front liner wall and opposing first and second side liner walls, said front liner wall being adjacent to said front carton wall, said first and second side liner walls being adjacent to said respective first and second side carton walls, at least one of said front liner wall and said side liner walls including a first stripped-out area entirely encompassed by paperboard material, said front liner wall and said side liner walls intersecting at adjoining corner posts, said first stripped-out area being spaced away from a nearest one of said corner posts, said first stripped-out area having a height generally greater than about half a distance between said top and bottom carton walls.

15. A paperboard carton-liner assembly, comprising:

an outer carton including opposing top and bottom carton walls, opposing front and back carton walls, and opposing first and second side carton walls, said front carton wall and said side carton walls including an integral and continuous horizontal tear element for opening up said carton from a sealed form to form a lid hingedly connected to a base;

a liner disposed within said outer carton and including a front liner wall and opposing first and second side liner walls, said front liner wall being adjacent to said front carton wall, said first and second side liner walls being adjacent to said respective first and second side carton walls, at least one of said front liner wall and said side liner walls including a first stripped-out area entirely encompassed by paperboard material, said front liner wall and said side liner walls intersecting at adjoining corner posts, said first stripped-out area being spaced away from a nearest one of said corner posts, said first stripped-out area including an arch-shaped upper end.

16. A paperboard carton-liner assembly, comprising:

an outer carton including opposing top and bottom carton walls, opposing front and back carton walls, and opposing first and second side carton walls, said front carton wall and said side carton walls including an integral and continuous horizontal tear element for opening up said carton from a sealed form to form a lid hingedly connected to a base;

a liner disposed within said outer carton and including a front liner wall and opposing first and second side liner walls, said front liner wall being adjacent to said front carton wall, said first and second side liner walls being adjacent to said respective first and second side carton walls, at least one of said front liner wall and said side liner walls including a first stripped-out area entirely encompassed by paperboard material, said front liner wall and said side liner walls intersecting at adjoining corner posts, said first stripped-out area being spaced away from a nearest one of said corner posts, said first stripped-out area including a downwardly-pointing, generally arrow-shaped lower end.

17. A paperboard carton-liner assembly, comprising an outer carton including opposing top and bottom carton walls, opposing front and back carton walls, and opposing first and second side carton walls, said front carton wall and said side carton walls including an integral and continuous horizontal tear element for opening up said carton from a sealed form to form a lid hingedly connected to a base; and a liner disposed within said outer carton and including a front liner wall and opposing first and second side liner walls, said front liner wall intersecting said first and second side liner walls at adjoining corner posts, said front liner wall being adjacent to said front carton wall, said first and second side liner walls being adjacent to said respective first and second side carton walls, each of said front liner wall and said side liner walls including a respective pair of stripped-out areas entirely encompassed by paperboard material, said respective pair of stripped-out areas being separated from each other by a strut and being spaced from said corner posts, said respective pair of stripped-out areas each including a downwardly-pointing, generally arrow-shaped lower end.

* * * * *